United States Patent [19]

Nicely

[11] Patent Number: 4,627,543

[45] Date of Patent: Dec. 9, 1986

[54] COMPRESSION SLEEVE CORNER STRUCTURE FOR ADJUSTABLE SHELVING

[75] Inventor: Charles W. Nicely, Dallas Township, Luzerne County, Pa.

[73] Assignee: United Steel & Wire Company, Battle Creek, Mich.

[21] Appl. No.: 748,548

[22] Filed: Jun. 25, 1985

[51] Int. Cl.[4] ..... A47F 5/00

[52] U.S. Cl. ..... 211/187; 108/144; 211/208

[58] Field of Search ..... 108/144, 111; 211/187, 211/208; 248/243

[56] References Cited

U.S. PATENT DOCUMENTS

| | | |
|---|---|---|
| 911,567 | 2/1909 | Berkowitz . |
| 3,173,385 | 3/1965 | Tucker . |
| 3,424,111 | 1/1969 | Maslow . |
| 3,523,508 | 8/1970 | Maslow . |
| 3,604,369 | 9/1971 | Maslow . |
| 3,664,274 | 5/1972 | Bustom . |
| 3,675,598 | 7/1972 | Kesilman et al. . |
| 3,757,705 | 9/1973 | Maslow . |
| 3,874,511 | 4/1975 | Maslow . |
| 4,128,064 | 12/1978 | Chung et al. . |
| 4,138,953 | 2/1979 | Tashman . |
| 4,237,798 | 12/1980 | Welsch et al. . |
| 4,257,333 | 3/1981 | Pollack . |
| 4,318,352 | 3/1982 | Friedman et al. . |

FOREIGN PATENT DOCUMENTS

| | | |
|---|---|---|
| 855715 | 5/1940 | France . |
| 1047554 | 12/1953 | France . |

*Primary Examiner*—Robert W. Gibson, Jr.

*Attorney, Agent, or Firm*—Flynn, Thiel, Boutell & Tanis

[57] ABSTRACT

A shelving unit employing a corner structure formed by two cooperative clamping members having a wedge relationship therebetween, one of the members being fixedly or removably attached to the shelf and the other being disposed so as to removably surround a support port.

5 Claims, 9 Drawing Figures

COMPRESSION SLEEVE CORNER STRUCTURE FOR ADJUSTABLE SHELVING

FIELD OF THE INVENTION

This invention relates to shelving and, more specifically, to improved adjustable shelving.

BACKGROUND OF THE INVENTION

Adjustable shelving employing shelves constructed of sheet metal or wire is well known and extensively utilized in numerous environments, whereby the shelving is exposed to not only a wide range of environmental conditions but is also exposed to widely varying shelf loads. Shelving of this general type, which is often referred to as knock-down shelving since it is intended to be readily assembled and disassembled, conventionally employs upright corner posts which are designed to permit horizontal shelves to be mounted thereon at selected vertical increments. The shelves and corner posts generally have a cooperating corner structure therebetween which is intended to facilitate the mounting of the shelf on the post. While many of the known shelf units have provided adequate strength and rigidity, nevertheless many of the known units have required assembly procedures which are more difficult than desired and hence have impaired the flexible utilization of the shelf unit, or have possessed structural features which have either failed to provide the desired strength and rigidity or have been unsuitable for use in restaurant and hospital environments requiring sanitary conditions.

In one common type of corner structure employed by a large number of conventional shelving units, each shelf is provided with corner structures fixedly associated with each corner thereof. This corner structure involves a closed collar structure defining therein a vertical opening for accommodating a corner post. With such arrangement, all four corner posts must be slidably inserted through the collars associated with the corners of each shelf, or in the alternative the individual shelf must be positioned with the collars aligned with the posts so that the shelf can be slid downwardly along the posts into position. Once the collars and posts have been properly interfitted and positionally related, then such shelving units conventionally employ separate wedge members or threaded fasteners for fixedly securing the shelf to the post at the desired elevation. This type of structural arrangement, however, increases the complexity of the assembly and disassembly operation. Further, shelving units of this type do not permit the addition or removal of an intermediate shelf after the shelving unit has been assembled without first requiring assembly or disassembly of the other shelving units disposed either above or below the intermediate shelf. This hence greatly restricts usage of the shelving unit since changes in the configuration of the shelving unit require complex assembly and disassembly procedures.

Another conventional configuration for known shelving units employs a corner structure which requires the use of threaded fasteners or the like for securing the individual shelves to the corner posts. In units of this type, the shelf itself directly connects to the corner post by threaded fasteners, or in the alternative a special corner member such as a collar or the like is fitted onto the corner post and this corner member in turn is secured to the shelf by threaded fasteners. Assembling shelving units in this fashion is also manually difficult and inefficient due to the difficulty in properly positioning and holding all of the various pieces, while at the same time attempting to position and secure the threaded fasteners. Such units often require two persons to accomplish the assembly operation. Further, shelving of this type often fails to provide the necessary strength and rigidity required to prevent the shelving unit from experiencing sway or lean when loaded.

Another problem associated with many of the known shelving units is the complexity of the corner structure used for connecting the shelves to the corner posts. Many of the known corner structures employ either a substantial number of pieces and/or pieces of extremely complex configuration which are expensive to fabricate. Such complex corner arrangements hence not only significantly and undesirable increase the cost of the shelving unit, but also often result in complex and difficult assembly techniques.

Examples of known shelving units of this general type are illustrated by U.S. Pat. Nos. 911,567, 3,173,385, 3,424,111, 3,523,508, 3,604,369, 3,664,274, 3,757,705, 3,874,511, 4,128,064, 4,138,953, 4,237,798 and 4,257,333.

Accordingly, it is an object of this invention to provide an improved adjustable shelving unit, specifically a metal shelving unit, having an improved corner structure coacting between the shelves and the corner posts.

More specifically, this invention relates to an improved shelving unit having a corner structure which facilitates both assembly and disassembly of the shelves with respect to the corner posts, which provides a wedging relationship so as to provide for a secure and rigid shelving unit when assembled, which provides increased flexibility with respect to modification of the shelving unit by permitting removal of an intermediate shelf without requiring disassembly of the complete unit, and which provides minimal cracks or crevices so as to permit utilization of the unit in environments requiring sanitary conditions.

Another object of the invention is to provide an improved shelving unit, as aforesaid, which permits assembly due to a wedging cooperation between two clamping members associated with the corner structure, whereby the assembly and disassembly does not require insertion or removal of threaded fasteners, whereupon the shelving unit can be easily and efficiently assembled by a single person.

Still another object of the invention is to provide an improved shelving unit, as aforesaid, which employs a corner structure formed by two basic cooperating clamping members having a wedge relationship therebetween, one of the members being fixedly or removably attached to the shelf and the other being disposed so as to surround the corner post, which two members wedgingly cooperate to provide a simple but rigid and strong securement of the corner structure to the post.

In a preferred embodiment of the improved shelving unit of this invention, each shelf is preferably of a planar matlike structure formed from a plurality of substantially parallel wires which extend between and are rigidly secured to supporting trusses which extend along the edges of the shelf. A corner structure coacts between each corner of the shelf and a respective corner post, which post is preferably of a tubular cross section and has dimplelike recesses formed therein at selected vertically spaced intervals. The corner structure employs a compression sleeve which surrounds the post and creates intimate clamping contact with the post over approximately the complete external periphery thereof. This compression sleeve is axially split to permit it to be snapped around the post and to also permit sufficient circumferential compression to clampingly engage the post. The compression sleeve has diametrically opposed pairs of projections on the inner wall thereof which are adapted to engage the dimples in the post. The external periphery of the compression sleeve has a plurality of circumferentially spaced recesses projecting axially downwardly from the upper end of the sleeve, which recesses have a converging wedgelike configuration bounded by converging sidewalls. The circumferentially adjacent recesses result in a similar wedgelike projection therebetween, which wedgelike projection converges axially upwardly. The compression sleeve is preferably constructed of a synthetic material, such as nylon. Each corner of the post has a rigid clamping collar secured thereto, which collar on the inner wall thereof defines a plurality of circumferentially spaced wedges which are of a converging configuration as they project axially downwardly. The wedges on the collar move axially downwardly into the recesses on the compression sleeve as the collar axially telescopes over the compression sleeve. The engagement of the wedges within the recesses effects a circumferentially directed compression of the compression sleeve due to the sleeve having axial slits formed therein between the circumferentially adjacent recesses, whereby the compression sleeve is circumferentially compressed into snug clamping and gripping engagement with the post.

Other objects and purposes of the invention will be apparent to persons familiar with structures of this general type upon reading the following specification and inspecting the accompanying drawings.

Figure 1:
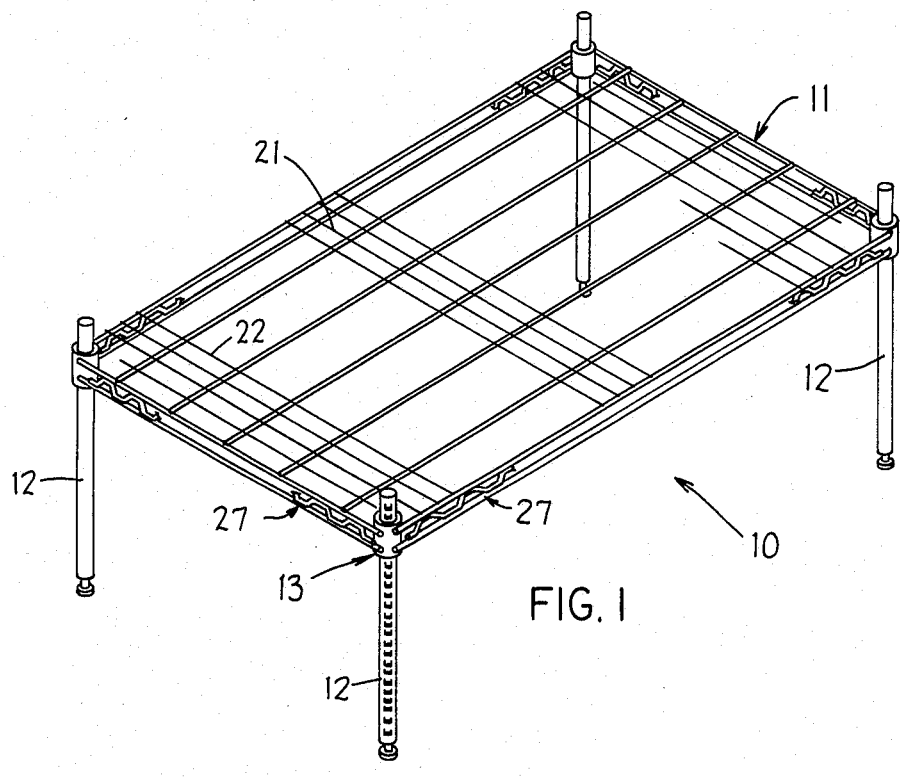
FIG. 1 is a fragmentary perspective view illustrating the shelving unit of this invention in an assembled condition, the shelving unit mounting thereon only a single shelf for convenience of illustration.
Figure 3:
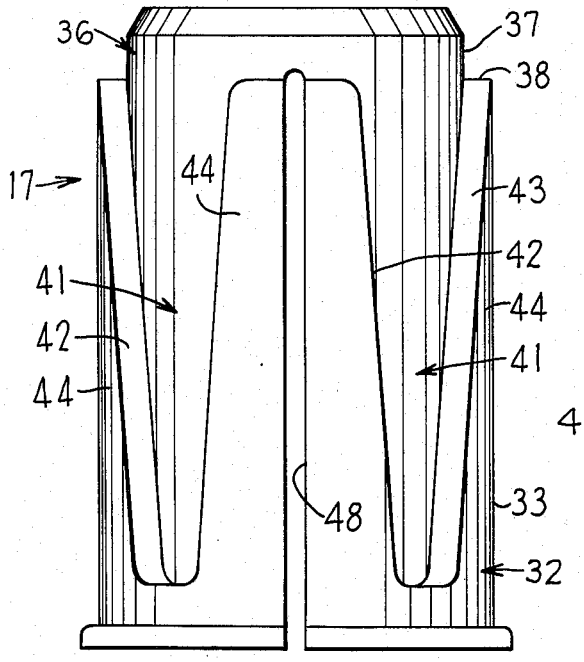
FIG. 3 is a side elevational view of the compression sleeve.
Figure 4:
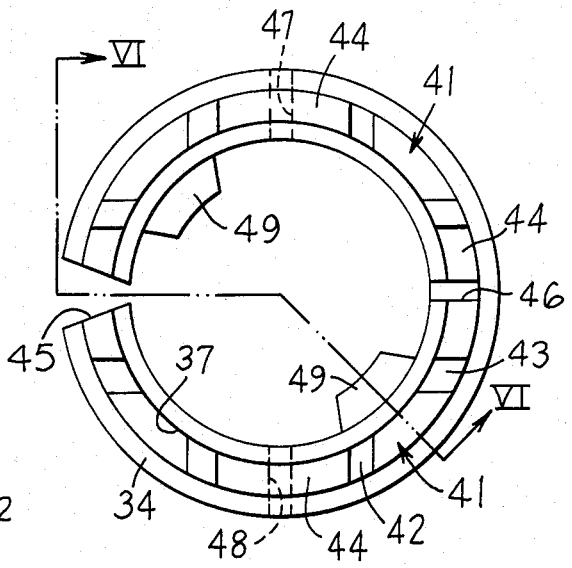
FIGS. 4 and 5 are top and bottom views, respectively, of the compression sleeve shown in FIG. 3.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the shelving unit and designated parts thereof. Said terminology will include the words specifically mentioned, derivatives thereof, and words of similar import.

DETAILED DESCRIPTION

Referring to FIG. 1, there is illustrated an adjustable, knock-down shelving unit 10 according to the present invention. The shelving unit typically includes a plurality of substantially horizontal shelves which are disposed in parallel but vertically spaced relationship, only one such shelf 11 being illustrated in FIG. 1 for purposes of illustration. The shelf 11 is supported by a plurality, here four, of upright corner posts 12. The corner of each shelf 11 is releasably attached to the respective corner post 12 by means of a separable corner structure 13.

The corner structure 13 of this invention is basically of a two-piece construction, and includes a first clamping member 16 which shall hereinafter be referred to as the clamping collar, and a second clamping member 17 which shall hereinafter be referred to as the compression sleeve.

The construction of the shelf 11 is generally conventional in that it includes a substantially planar mat 21 formed from a plurality of parallel metal wires or rods 22 which are disposed in sidewardly spaced relationship and extend transversely across the width of the shelf. The mat wires 22 are fixedly secured to and supported on upper longitudinally extending wires or rods 23, which longitudinal rods 23 are disposed adjacent the front and rear edges of the shelf. One or more additional longitudinal wires 24 are also normally positioned to extend longitudinally under the center of the shelf to provide additional strength and reinforcement. The upper wire 23 and a parallel lower longitudinal wire 25 are rigidly secured together by means of a welded truss wire 26 extending therebetween so as to define a truss 27 which extends longitudinally along both the front and rear edges of the shelf. Similar such trusses are also fixedly secured to and extend along the side edges of the shelf. If necessary, a similar truss can also extend longitudinally along the longitudinal centerline of the shelf.

Figure 2:
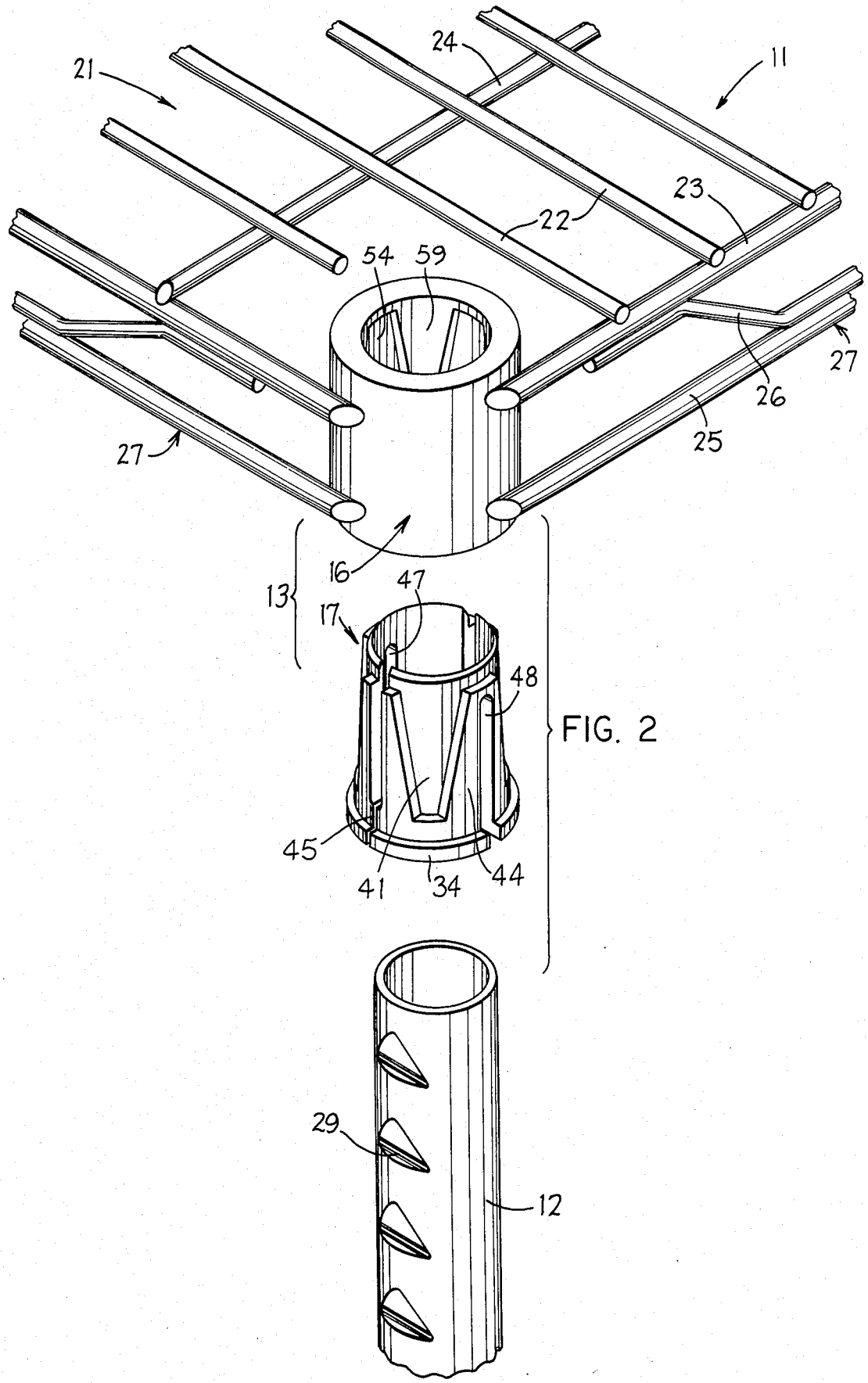
FIG. 2 is an enlarged fragmentary perspective view illustrating, in an exploded manner, a corner of the shelf and the cooperating corner structure which connects the shelf to the post.
Figure 5:
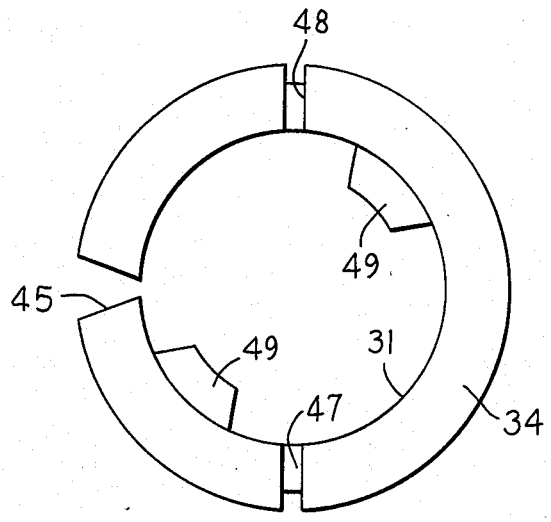
Figure 6:
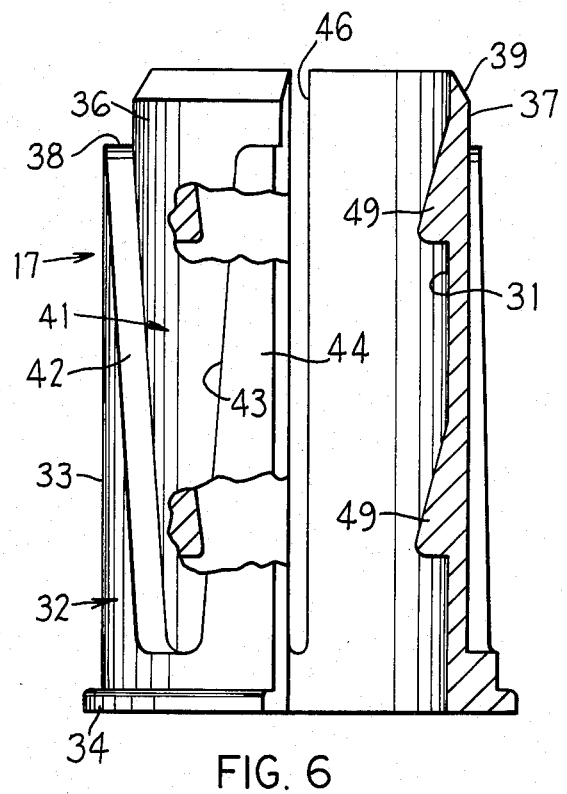
FIG. 6 is an elevational view, partially in cross section, of the compression sleeve.

As to the post 12, same comprises a vertically elongated channel, preferably a closed channel such as a tube. The post preferably has a cylindrical tubular cross section to provide optimum strength and ease of usability and assembly. The post, conventionally of steel, is preferably provided with two rows of indentations or recesses 29, hereinafter referred to as dimples, formed therein, which rows of dimples 29 extend longitudinally of the post and are disposed on diametrically opposite sides thereof (only one row being illustrated in FIG. 2). The dimples 29 within each row are preferably uniformly vertically spaced apart at relatively small increments, such as vertical spacings of about one inch, to permit the individual shelves to be vertically positioned at the desired elevations. While the dimples 29 are preferably formed merely by effecting a suitable deformation of the sidewall of the tube so that the dimple comprises only a shallow recess which normally defines a shoulder at the lower end thereof, nevertheless it will be appreciated that the dimples could be replaced by holes which penetrate the tube wall if desired. However, use of dimples is preferred.

Considering now the compression sleeve 17, and referring specifically to FIGS. 3–6, this compression sleeve comprises a one-piece member preferably constructed of a hard but somewhat resilient plastics material, such as by being molded of nylon. The compression sleeve 17 has a substantially cylindrical opening or bore 31 extending coaxially therethrough, which bore is of uniform diameter. The sleeve includes a main sleeve part 32 of substantial axial extent and defined by an outer annular wall 33 which is substantially of uniform diameter, although this outer annular wall 33 preferably has a slight converging taper from bottom to top, such as 1° or less, to facilitate removal of the sleeve from the mold. This main sleeve part 32, at the lower end thereof, is provided with a radially enlarged annular flange 34.

Compression sleeve 17 also includes a top sleeve part 36 which is of reduced diameter in relationship to and projects upwardly from the main sleeve part 32. This top sleeve part 36 has a uniform outer cylindrical surface 37 of a diameter which is less than the diameter of the outer annular wall 33, whereby the main sleeve part 32 defines an upper axial end wall or annular shoulder 38 at the interface with the top sleeve part 36. The top sleeve part 36 preferably has the upper end thereof beveled at 39 to eliminate sharp corners. The main cylindrical opening or bore 31 of uniform diameter extends continuously through the main and top sleeve parts 32 and 36, respectively, so that the top sleeve part 36 is merely of reduced wall thickness in relationship to the main sleeve part 32. In addition, this top sleeve part 36 projects upwardly from the annular shoulder 38 through only a small axial extent.

The main sleeve part 32 has a plurality, preferably four, of wedge-receiving recesses 41 formed therein. These recesses 41 project axially downwardly from the annular shoulder 38 and extend throughout a majority of the axial length of the main sleeve part, although these recesses 41 are closed at the lower end and preferably terminate somewhat short of the flange 34. The recesses 41 are defined between opposed sidewalls 42 and 43, which sidewalls each extend at an angle relative to the longitudinal axis of the sleeve, and the sidewalls 42 and 43 themselves converge toward one another as they project downwardly. The recess 41 opens outwardly through the outer annular wall 33, although the bottom or inner radial surface of the recess is closed by a substantially cylindrically generated wall which constitutes an extension of the cylindrical outer surface 37 of the top sleeve part 36. The plurality of recesses 41 are uniformly angularly spaced apart around the compression sleeve and, since the sleeve preferably is provided with four such recesses, these recesses are disposed with the axial centerlines thereof spaced at 90° intervals.

The compression sleeve 17 also has a plurality of axially elongated slots or slits formed therein to provide the sleeve with the ability to be circumferentially deformed. For this purpose, a first pair of diametrically opposite slots 45 and 46 project downwardly from the upper end of the sleeve through a majority of the axial extent thereof, the lower ends of the slot 46 terminating at a point adjacent to but preferably just past the closed ends of the recesses 41. These slots 45 and 46 are disposed angularly midway between an adjacent pair of recesses 41 and hence extend substantially along the longitudinal centerline of the intermediate wedge part 44 as defined between adjacent recesses 41.

A further pair of diametrically opposed slots 47 and 48 are also formed in the compression sleeve, with these latter slots 47 and 48 being angularly spaced 90° from the slots 45 and 46, whereby the four slots are uniformly angularly spaced apart at 90° intervals. The slots 47 and 48 project axially upwardly from the lower end of the sleeve through a majority of the axial length of the sleeve, with the closed upper ends of these slots terminating in the vicinity of and preferably just slightly above the shoulder 38. These slots 47 and 48 also individually extend substantially along the longitudinally extending centerline of one of the wedgelike parts 44.

To facilitate positioning of the compression sleeve on the post, one of the slots 45 and 46, specifically the slot 45, projects axially downwardly throughout the full axial extent of the compression sleeve so as to intersect the bottom flange 34, thereby creating an axial slit which extends the full axial length of the sleeve. This enables the sleeve to be resiliently flexed into an open position so as to enable it to be sidewardly inserted over and in surrounding relationship to the post.

The provision of the recesses 41 in the main sleeve part 32 results in the formation of the wedgelike parts 44 disposed between each adjacent pair of recesses. Each wedgelike part 44 projects axially upwardly of the sleeve and is defined between the sidewalls 42 and 43 so that the wedgelike part is of a converging configuration as it projects upwardly. This wedgelike part 44 terminates at the shoulder 38.

Figure 7:
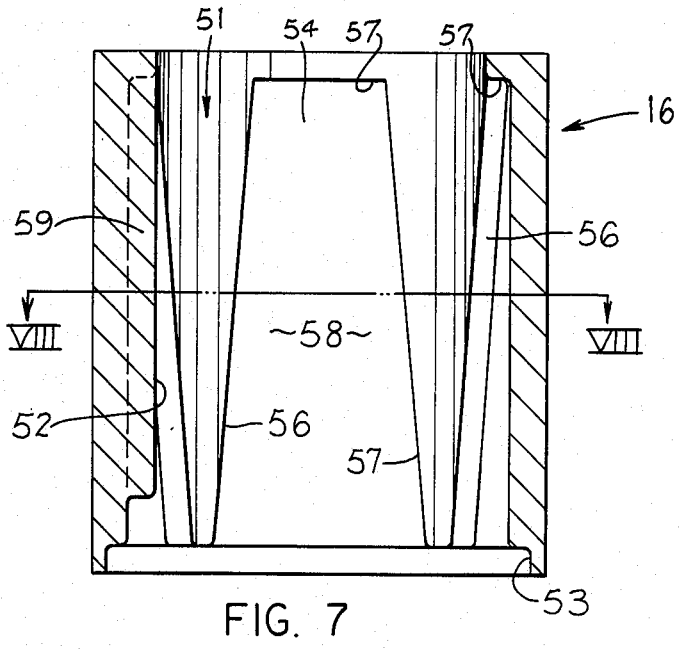
FIG. 7 is a sectional view of the clamping collar as taken substantially along line VII—VII in FIG. 8.
Figure 8:
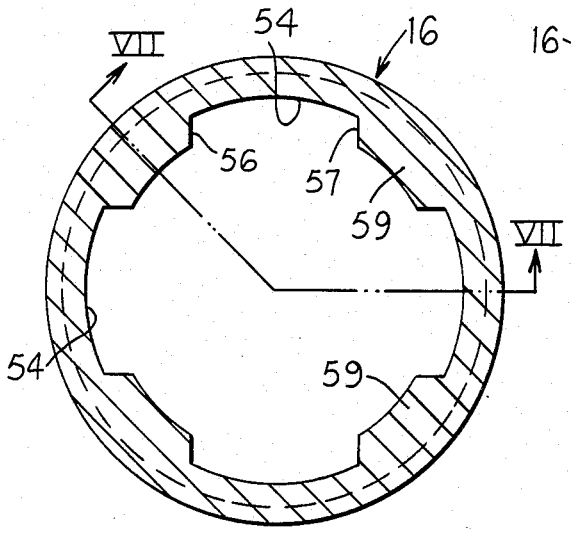
FIG. 8 is a sectional view taken substantially along line VIII—VIII in FIG. 7.

Considering now the clamping collar 16, and referring specifically to FIGS. 7 and 8, same comprises a one-piece rigid sleeve constructed of metal, such as by being machined or cast. The clamping collar has an axial length which substantially corresponds to the length of the compression sleeve, and the collar has a cylindrical bore 51 of substantially uniform diameter extending coaxially therethrough. This bore defines an inner annular wall 52, the diameter of which is normally slightly greater than the maximum diameter of the outer annular wall 33 on the compression sleeve. This bore 51, at the lower end of the collar, terminates in a surrounding enlarged annular groove 53 which is provided so as to accommodate the annular flange 34 provided on the lower end of the compression sleeve.

Collar 17 has a plurality, preferably four, of wedge-receiving recesses 54 formed internally thereof. These recesses 54 project axially upwardly from the lower end of the collar and are bounded by opposed sidewalls 55 and 56, the latter extending at an angle relative to the longitudinal axis of the collar, whereby the sidewalls 55 and 56 converge toward one another as they project upwardly. This recess 54 projects through a majority of the axial length of the collar but is closed at the upper end by means of a top wall 57 which is spaced downwardly a small distance from the upper end of the collar. The included angle defined between the sidewalls 55 and 56 corresponds to the included angle defined between the sidewalls 42 and 43 associated with the recess of the compression sleeve. In fact, the size of the recess 54 is designed so as to wedgingly receive therein the wedgelike part 44 associated with the compression sleeve. These recesses 54 are uniformly angularly spaced apart around the collar and, since preferably four such recesses are provided, the recesses 54 are spaced apart at 90° intervals. The recesses 54 open inwardly through the inner annular wall 52, but the radially outer boundary of the recesses is suitably closed by a cylindrically generated back surface 58, which surface effectively defines a cylinder of a diameter which is slightly greater than the maximum diameter of the outer annular wall 33 of the compression sleeve. The presence of these recesses 54 formed in the inner wall of the collar results in the defining of downwardly projecting wedgelike parts 59 disposed between each adjacent pair of recesses 54, which wedgelike parts 59 are accommodated within the recesses 41 of the compression sleeve.

While the assembly of the shelving unit 10 according to this invention is believed apparent from the above description, nevertheless same will be briefly described to ensure a complete understanding thereof.

To assemble the first shelf 11 to the set of four posts 12, the compression sleeve 17 is circumferentially split so as to be sidewardly passed over and around the respective post. The sleeve is initially positioned so that the projections 49 are not aligned with the dimples 29, whereupon the sleeve 17 can be axially slidably displaced to the desired location, and then rotated so that the projections 49 resiliently snap into the dimples 29. After each of the four posts has a compression sleeve thereon, which compression sleeves are oriented so that the recesses 41 open upwardly, then the upper free end of a post 12 is inserted through one of the clamping collars 16, and the post and compression sleeve are suitably rotated so that the wedgelike parts 44 on the compression sleeve are axially aligned with the recesses 54 in the clamping collar. The compression sleeve and clamping collar are axially telescoped together, whereupon the sidewalls 56 and 57 of the clamping collar wedgingly bear against the sidewalls 42 and 43 of the compression sleeve. This axial wedging relationship effects a circumferential distortion and compression of the clamping sleeve 17 due to the provision of the slots or slits 45–48 therein. The clamping collar and compression sleeve are axially telescoped together until the compression sleeve 16 is suitably formed so as to be maintained in snug gripping engagement with the post 12, thereby positively locking the projections 49 in the dimples 29.

The above assembly procedure is then repeated for the other three posts until the lowermost shelf 11 is rigidly secured to and supported on the four posts.

If the mounting of additional shelves is desired, then additional compression sleeves are appropriately positioned on the posts in upwardly spaced relationship from the lowermost shelf. A further shelf is then disposed with the upper ends of the posts projecting through the clamping collars, whereupon the shelf is then moved downwardly so that the clamping collars are telescopically moved downwardly over the compression sleeves. The clamping collars of the shelf are wedged downwardly to again cause the required circumferential compression of the respective compression sleeves to lock the latter to the respective posts.

Figure 9:
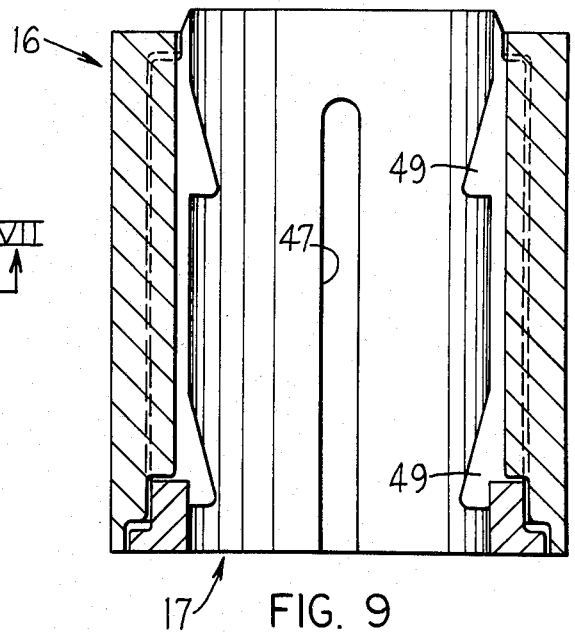
FIG. 9 is a central sectional view illustrating the clamping collar and compression sleeve in an assembled condition.

When the collar and compression sleeve are assembled to the post, as illustrated in FIG. 9, the beveled end of the compression sleeve projects slightly above the upper surface of the clamping collar, with the top sleeve part 36 of the compression sleeve having a fairly snug fit within the bore 51 so as to prevent the creation of any excess clearances or grooves which would tend to collect contaminants. Similarly, the annular flange 36 on the bottom of the compression sleeve fits up into the annular groove 53 in the lower end of the clamping collar so as to effectively close off the lower end of the latter. However, the compression of the sleeve 16 occurs due to the circumferential hoop stresses created by the cooperating wedges and recesses, coupled with the provision of the axial slots in the sleeve, inasmuch as the surfaces 33 and 58 normally remain spaced from one another so as to not interfere with the desired circumferential compression of the sleeve 17.

The wedging surfaces defined by the sidewalls 42–43 and 56–57 preferably extend at a small angle, such as in the range of 3° to 5°, relative to the axial direction.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a shelving unit having a plurality of upright posts, at least one shelf, and a corner structure coacting between said shelf and each said post for stationarily securing said shelf to said posts at a selected location, comprising the improvement wherein:

said corner structure includes first and second separable clamping members for clampingly connecting a corner of the shelf to one of the posts;

said first clamping member comprising a one-piece compression sleeve constructed of a synthetic material and having a bore of substantially uniform diameter extending therethrough for accommodating the post therein, said compression sleeve having a projection which projects radially inwardly of said bore for engagement with a dimple provided in the respective post;

said compression sleeve including a plurality of angularly spaced and axially projecting recesses formed therein and extending axially downwardly from the upper end thereof, said recesses having a width as measured in the circumferential direction of the sleeve which is of a converging tapered cross section as the recess projects axially downwardly, said recesses opening through only a portion of the wall thickness of the compression sleeve so that the recesses open outwardly through the outer annular wall of the sleeve, said recesses having a back wall thereof defined by a surface of generally cylindrical configuration;

said compression sleeve also having a plurality of narrow but axially elongated slots formed therein and extending radially through the sidewall thereof, said plurality of slots including a first slot which is disposed midway between an angularly adjacent pair of said recesses and opens axially upwardly from the lower end of said compression sleeve, said first slot extending through a majority of the axial length of said sleeve but terminating short of the upper end thereof, said plurality of slots including a second axially elongated slot which is also disposed midway between an angularly adjacent pair of said recesses and opens axially downwardly from the upper end of said sleeve, said second slot extending over a majority of the axial length of said sleeve but terminating short of the lower end thereof;

said second clamping member comprising a one-piece rigid collar constructed as a non-split sleeve member, said collar being fixed to said shelf adjacent a corner thereof so that said collar defines a substantially cylindrical bore which extends coaxially and vertically therethrough;

said collar including a plurality of angularly spaced wedgelike parts which project axially upwardly from the lower end thereof, said wedgelike parts being of a diverging cross section in the peripheral direction of the collar as they project axially upwardly; and said collar being axially telescoped downwardly over said compression sleeve with said wedgelike parts being wedging received into the recesses of the compression sleeve to effect circumferential compression of the sleeve and radial inward deformation thereof into snug gripping engagement with the post.

2. A unit according to claim 1, wherein the compression sleeve has four said recesses spaced uniformly therearound and said collar has four said wedgelike parts spaced uniformly therearound, said plurality of slots including a pair of said first slots disposed on diametrically opposite sides of said compression sleeves and a pair of said second slots disposed on diametrically opposite sides of said compression sleeves, said second slots being spaced apart from said first slots by an angle of about 90° therebetween.

3. A unit according to claim 2, wherein only one of said slots extends axially throughout the complete length of said compression sleeve to permit the sleeve to be spread so as to be moved sidewardly into surrounding engagement with the post.

4. A unit according to claim 3, wherein said compression sleeve is constructed of nylon.

5. A unit according to claim 2, wherein the recesses in the compression sleeve and the wedgelike parts on the collar have longitudinally extending sidewalls which extend at an angle of about 3° to about 5° relative to the longitudinal axis and define an included angle therebetween in the range of about 6° to about 10°.

* * * * *